United States Patent [19]

Correro

[11] Patent Number: 4,848,767

[45] Date of Patent: Jul. 18, 1989

[54] ELECTRIC GAME

[76] Inventor: Dominic F. Correro, 114 Melbourne Dr., Maryville, Tenn. 37801

[21] Appl. No.: 222,416

[22] Filed: Jul. 21, 1988

[51] Int. Cl.[4] ..... A63F 9/00

[52] U.S. Cl. ..... 273/138 A; 273/1 E; 273/139; 273/238

[58] Field of Search ..... 273/1 GC, 1 E, 138 A, 273/139, 238

[56] References Cited

U.S. PATENT DOCUMENTS

| | | | |
|---|---|---|---|
| 1,268,397 | 6/1918 | Sigler | 273/238 |
| 3,085,803 | 4/1963 | Krzes . | |
| 3,092,390 | 6/1963 | Super | 273/139 X |
| 3,194,560 | 7/1965 | White | 273/1 E X |
| 3,844,567 | 10/1974 | Marker . | |
| 3,866,920 | 2/1975 | Goldfarb et al. | 273/138 A |
| 3,927,880 | 12/1975 | Petrusek | 273/1 E |
| 4,023,807 | 5/1977 | Santianni . | |
| 4,103,890 | 8/1978 | Treasarden | 273/1 GC |
| 4,365,811 | 12/1982 | Krzes . | |

*Primary Examiner*—Anton O. Oechsle

[57] ABSTRACT

An electrical game wherein probes are withdrawn from holes in a game board; only one of the probes is electrically-conductive. When the electrically-conductive probe is withdrawn from the game board an audible alarm sounds, ending the game. The player having the most probes is declared the winner.

12 Claims, 1 Drawing Sheet

ELECTRIC GAME

BACKGROUND OF THE INVENTION

This invention relates to a game wherein a number of probes (rods) are insertable into holes in a game board. The players take turns withdrawing the probes from the holes (one probe per turn). One of the probes is electrically conductive, whereby when that probe is withdrawn from the game board an audible alarm is sounded. The player having the most probes when the alarm sounds is the game winner.

SUMMARY OF THE INVENTION

An object of the invention is to provide a game wherein a number of probes (e.g. fifty) can be positioned in probe holes in a game board, such that the players do not know the location of the electrically-conductive probe. The players have a feeling of wonder and suspense as each individual player withdraws a probe from the game board. An important feature of my invention is the fact that all of the probes have the same outward visual appearance. The players do not know which probe is electrically conductive.

My invention can be practiced with each probe in the form of a rod element having an enlarged head structure that resembles a flower, e.g. a daisy or a four leaf clover. The game can include an audible alarm in the form of a buzzer. The game is played so that when a player withdraws a probe from the board he/she is supposedly picking one the flowers. When the electrically-conductive probe is withdrawn from the board the buzzer emits a sound that resembles a buzzing sound of a bee. The game can be entitled "Don't Get Stung" or some similar name that ties together flowers and bees.

THE DRAWINGS

DESCRIPTION OF A PREFERRED EMBODIMENT OF THE INVENTION

Figure 1:
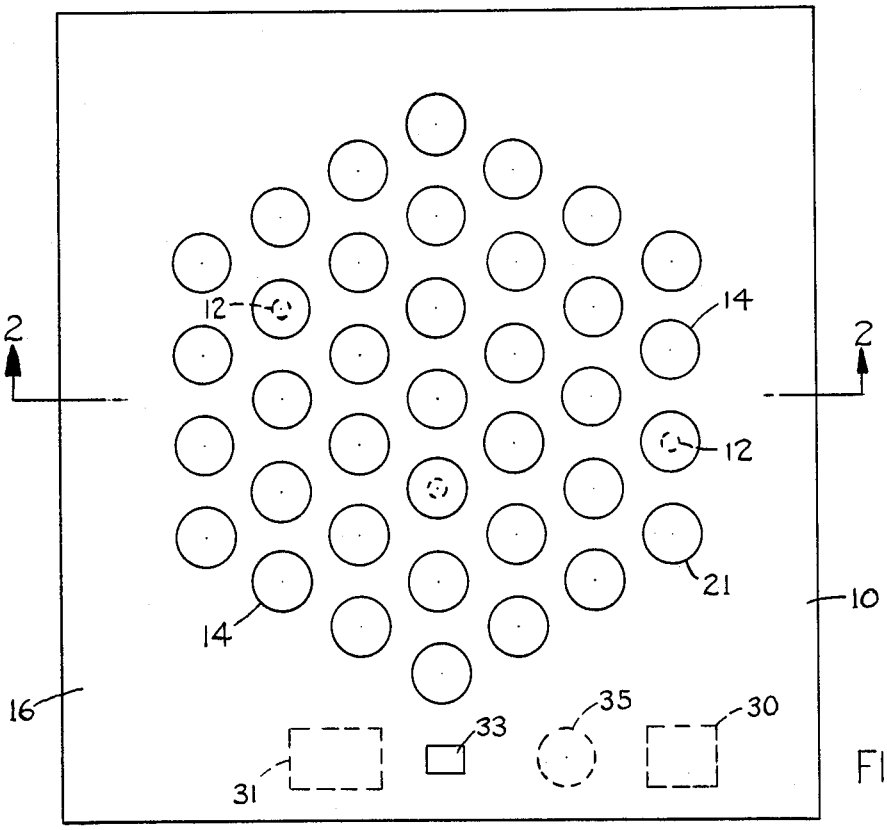
FIG. 1 is a top plan view of a game board embodying features of my invention.
Figure 2:
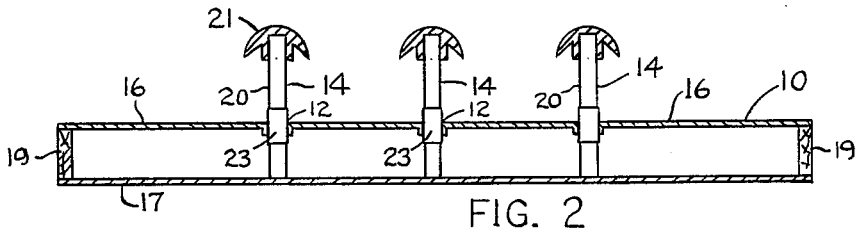
FIG. 2 is a sectional view on line 2—2 in FIG. 1.

FIG. 1 shows a top plan view of a game board 10 embodying my invention. The board has thirty seven probe holes 12 in its upper surface. Each probe hole is adapted to receive a probe 14. FIG. 2 shows three such probes inserted into holes in the game board. The invention may be practiced with any desired number of probe holes (and probes), e.g. fifty or more.

Game board 10 comprises an upper panel 16 and lower panel 17 spaced apart by wooden (non-conductive) strips 19. The aforementioned probe holes are formed in the upper panel. Both panels are formed of electrically-conductive material (wholly or partly).

Each probe 14 comprises a tubular plastic rod element 20 having an enlarged head structure 21 secured to its upper end. In preferred practice of the invention each head structure has the ornamental appearance of a flower, e.g. a rose, tulip, etc. In the illustrated arrangement there are thirty seven probes 14 (one for each probe hole). Only one of the probes is electrically conductive; the other thirty six probes are non-conductive.

Figure 3:
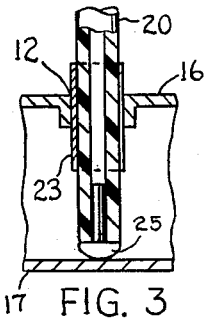
FIG. 3 is an enlarged sectional view of a probe used in playing a game according to my invention.
Figure 4:
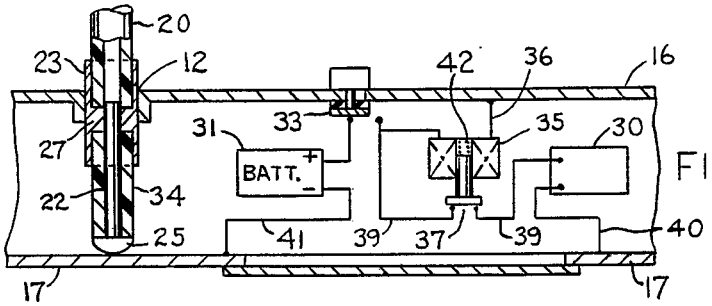
FIG. 4 is a view that illustrates an electrical circuit embodied in the FIG. 1 game board.

The non-conductive probes may be manufactured as shown in FIG. 3; the single conductive probe may be made as shown in FIG. 4. As seen in FIG. 3, the probe comprises a plastic tube (hollow rod) 20 having a conductive sleeve 23 secured thereon. A conductive rivet 25 has a shank area thereof press fit into the hole in tube 20.

The probe shown in FIG. 4 is substantially similar to the FIG. 3 probe except that conductive sleeve 23 has an internal plug section 27 that makes electrical contact with the shank area 22 of conductive rivet 25; a tubular spacer 34 spaces the rivet from the tube 20. When the FIG. 4 probe is inserted into any probe hole 12 sleeve 23 and rivet 25 provide an electrical connection between panels 16 and 17. The FIG. 3 probe does not provide such a connection. In outward appearance the probes are identical. FIGS. 3 and 4 are merely illustrative of one way in which to obtain probes that are electrically different but visually similar.

FIG. 4 schematically shows an electrical circuit that can be embodied in the FIG. 1 game board. The circuit includes an audible alarm 30, preferably a buzzer that emits a buzzing sound resembling that of a bee. The circuit is constructed so that when the single electrically-conductive probe (FIG. 4) is withdrawn from the game board the alarm emits an audible signal. When any of the non-conductive probes are withdrawn from the game board the alarm 30 remains silent.

The FIG. 4 circuitry includes a battery 31 connected to one pole of an on-off manual switch 33. The other pole of the switch is connected to a relay winding 35; a conductor 36 electrically connects the winding to upper panel 16. Relay contacts 37 are in a circuit line 39 that connects the switch to alarm 30. The alarm and battery 31 have ground connections 40 and 41 to lower panel 17. With switch 33 in its off position the relay contacts 37 are closed by a spring 42 in the relay. Switch 33 prevents current flow.

When playing the game the various probes are first inserted into the probe holes 12 in the game board. The single electrically-conductive probe forms an electrical connection between panels 16 and 17. With the probes in place, switch 33 may be shifted to the on position, thus energizing relay winding 35 through a circuit that includes conductor 36, panel 16, the conductive probe, panel 17 and ground connector 41. As winding 35 is energized contacts 37 are opened so that alarm 30 remains silent.

Withdrawing the non-conductive probes (FIG. 3) from the game board produces no alarm signal (buzzing). When the single conductive probe is withdrawn from the game board the relay winding 35 is de-energized, thereby closing contacts 37 to enable alarm 30 to emit an audible signal. This ends the game.

The game can be played so that the person withdrawing the conductive probe is declared the winner. Alternately, the game winner can be the player having the most probes when the alarm sounds. Other variations are possible.

Figure 5:
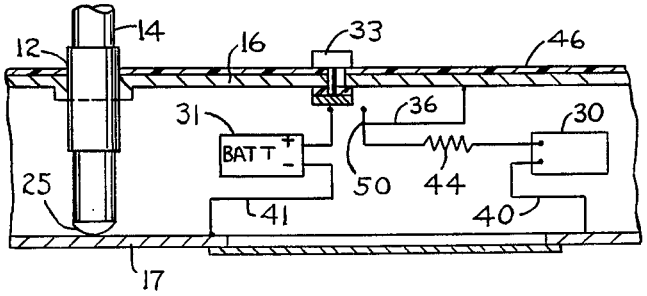
FIG. 5 illustrates an alternate electrical circuit to that shown in FIG. 4.

FIG. 5 illustrates alternate circuitry that can be used. In This case the relay is replaced with a resistance 44. Also, an insulative film 46 may be provided on the exposed face of panel 16.

With the probes inserted into the various holes 12 in the game board, and with switch 33 in its on position, a current path is established from battery 31, through switch 33, conductor 36, panel 16, the conductive probe, panel 17, and ground connector 41. Resistance 44 is selected so that insufficient current flows through alarm 30 to produce an audible signal.

When the conductive probe is withdrawn from the game board all of the battery current flows from junction 50 through resistance 44 and alarm 30. The increased current flow produces an alarm signal.

The drawings show specific forms that the invention can take. Other forms are possible.

I claim:

1. A game comprising a board having a plural number of probe holes therein; a plural number of probes, one for each hole; only one of said probes being electrically conductive; electric circuit means within the game board; said circuit means including an audible alarm; said circuit means being constructed so that when the electrically conductive probe is inserted into any one of the probe holes the alarm is silent, and when the electrically conductive probe is removed from a probe hole the alarm is energized.

2. The game of claim 1 wherein the electrically conductive probe has the same visual appearance as the non-conductive probes.

3. The game of claim 1 wherein the board comprises two spaced electrically-conductive panels; said panels forming parts of the aforementioned electric circuit means.

4. The game of claim 3 wherein the electrically-conductive probe includes a means thereon for completing an electrical connection between the two panels when said electrically-conductive probe is inserted into any one of the probe holes.

5. The game of claim 1 wherein the board comprises an upper panel formed of electrically-conductive material and lower panel formed of electrically-conductive material; the aforementioned probe holes being formed in said upper panel.

6. The game of claim 5 wherein the electrically-conductive probe includes means thereon for completing an electrical connection between the two panels when said electrically-conductive probe is inserted into any one of the probe holes.

7. The game of claim 1 wherein each probe comprises a rod element and an enlarged head structure secured to one end of the rod element.

8. The game of claim 7 wherein each head structure has the ornamental appearance of a flower.

9. The game of claim 1 wherein said circuit means comprises a battery, the aforementioned audible alarm, and an on-off switch controlling current flow to the audible alarm.

10. The game of claim 9 wherein the board comprises an upper panel formed of electrically-conductive material and a lower panel formed of electrically-conductive material; the aforementioned probe holes being formed in said upper panel; said on-off switch being mounted on said upper panel to control current flow between the battery and the upper panel; said battery and audible alarm having circuit connections to the lower panel.

11. The game of claim 10 wherein the electrically-conductive probe comprises a plastic rod element having an electrically-conductive sleeve engagable with the upper panel when said electrically-conductive probe is inserted in any one of the probe holes.

12. The game of claim 11 wherein said electrically-conductive probe comprises an electrical contact element engagable with the lower panel when said electrically-conductive probe is inserted in any one of the probe holes.

* * * * *